United States Patent [19]

Costales et al.

[11] 4,112,666

[45] Sep. 12, 1978

[54] COMPENSATING DRIVE FOR REVOLVING RINGS

[76] Inventors: Manuel Costales; Moustafa I. Hakki, both of P.O. Box 884, Belmont, N.C. 28012

[21] Appl. No.: 854,597

[22] Filed: Nov. 25, 1977

[51] Int. Cl.[2] ..... D01H 7/58; D01H 1/20

[52] U.S. Cl. ..... 57/105; 57/122; 57/124; 57/156

[58] Field of Search ..... 57/75, 105, 122, 124, 57/156

[56] References Cited

U.S. PATENT DOCUMENTS

| | | | |
|---|---|---|---|
| 2,541,238 | 2/1951 | Goree | 57/124 |
| 3,025,657 | 3/1962 | Noordenbos | 57/75 |
| 3,494,120 | 2/1970 | Chilpan et al. | 57/124 X |
| 3,738,094 | 6/1973 | Costales et al. | 57/124 X |

*Primary Examiner*—John Petrakes
*Attorney, Agent, or Firm*—Wendell Coffee

[57] ABSTRACT

The revolving ring on a spinning machine as seen in U.S. Pat. No. 4,023,340 is rotated by a belt encircling the bottom of the ring holder. The drive pulley is located below the ring by the spindle rail. An idler pulley moves outward to compensate for the change in distance between the revolving ring and the drive pulley.

7 Claims, 3 Drawing Figures

COMPENSATING DRIVE FOR REVOLVING RINGS

BACKGROUND OF THE INVENTION (1) Field of the Invention

This invention relates to textile machines for spinning, twisting and twining, and more particularly for machines with rotating rings.

(2) Description of the Prior Art

Previous workers in the art have suggested the ring of a spinning machine be rotated. We have patented a machine with a rotating ring, both in U.S. Pat. No. 4,023,340 and 3,738,094. In each of these machines the drive pulley was located on the level approximately horizontal with the point of mid-travel of the base of the ring. The belt from the drive pulley drove a disc which drove the ring by frictional contact. The belt was elastic to compensate for the difference in distance between the drive pulley and the driven disc as the ring rail reciprocated upward and downward along the bobbin.

SUMMARY OF THE INVENTION

New and Different Function

According to this invention the drive belt is trained from the drive pulley on the spindle rail around an idler pulley around a shell which drives four or more rings directly. The idler pulleys are moved out and in to compensate for the difference in distance between the drive pulley and the drive rings.

Objects of This Invention

An object of this invention is to spin or twist fibrous yarn or continuous filament.

Another object of this invention is to provide an improved drive means for rotating spinning rings.

Further objects are to achieve the above with a device that is sturdy, compact, durable, lightweight, simple, safe, efficient, ecologically compatible, energy conserving, and reliable, yet inexpensive and easy to manufacture, install, adjust, operate and maintain.

Other objects are to achieve the above with a method that is ecologicslly compatible, energy conservind, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
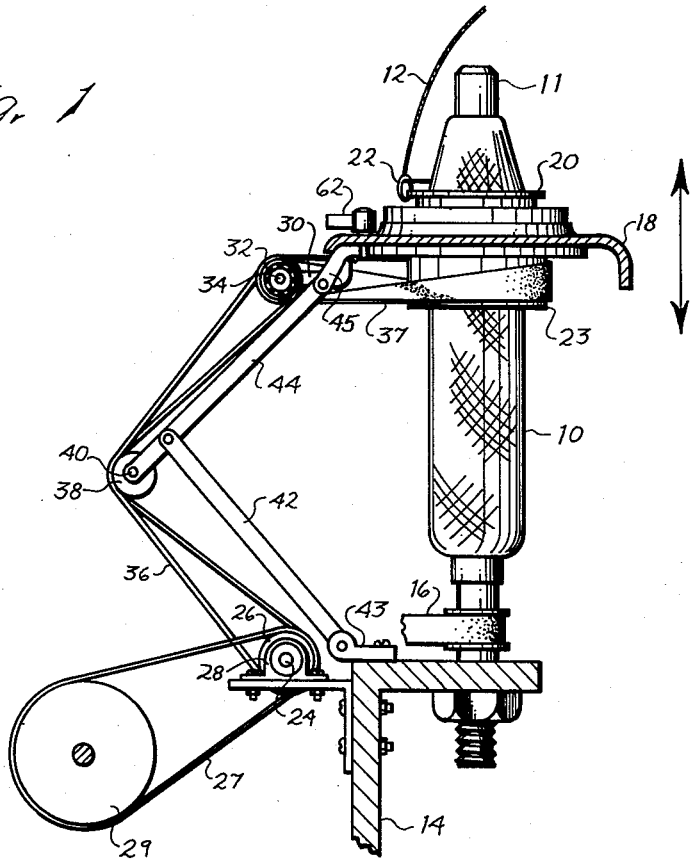
FIG. 1 is a sectional view showing a spinning machine with an embodiment of our invention attached thereto.

Referring to the drawing, there is seen illustrated a conventional spinning machine in many respects. Specifically in FIG. 1 of the drawing, there is illustrated bobbin 10 with yarn 12 being wound thereon. The machine has a frame which includes spindle rail 14. The bobbin is on bobbin spindle 11 which is journalled to spindle rail frame for rotation on it. Bobbin belt 16 is a portion of a bobbin driver means located on the frame for rotating the bobbin at high speed. Ring rail 18 is mounted upon the machine for up and down movement or vertical reciprocation relative to the spindle rail 14. This vertical reciprocation of the rail 18 is indicated by a double headed arrow.

Those skilled in the art will understand that a machine would have a plurality of bobbins thereon and that the rail 18 surrounds each of the bobbins.

Ring 20 is journalled for rotation on the rail 18. Traveler 22 is slidably mounted on the ring for movement around the ring and around the bobbin. Those skilled in the art will understand the traveler on each ring is for feeding yarn onto each bobbin. The ring is mounted upon holder 23 and the holder is journalled to the rail 18 by bearings as more specifically described at a later point.

Drive shaft 24 extends the length of the machine, so that it drives a plurality of the rings 20. For each four or more rings there is one shell 32 mounted behind the ring rail 18. The drive shaft 24 is attached to spindle rail 14 by any convenient means, e.g., pillow blocks 28 on a bracket. The shaft 24 is driven by main belt 27 from main cylinder 29 of the frame.

Arms 30 extend outward from the underside of the ring rail 18. Each of the shells 32 are journalled upon shaft 34 attached by cap 31 to the ends of the arms 30. Shell drive belt 36 extends from the drive pulley 26 to the shell 32. Ring drive belt 37 goes from the shell 32 to the ring holder 23. Therefore, it may be seen that the rings 20 are driven responsive to rotation of the drive pulley 26, which itself is responsive to main cylinder 29.

Rail 18 moves upward and downward and therefore, the distance from the drive pulley 26 to the shell 32 is always changing. Obviously, the belt 36 must be taut to operate properly.

We have placed two idler pulleys 38 upon ring idler arm 44 to maintain the belt 36 taut. The idler pulleys 38 are journalled to the arm 44 by shaft 40. Ring arm 44 is pivoted to spindle idler arm 42 adjacent to the idler pulley 38. The pivot of the ring arm 44 is between the pulley 38 and the connection of the ring idler arm 44 to the ring rail 18. Spindle arm 42 is pivoted about bracket 43 which is attached to the spindle rail 14 adjacent to the drive shaft 24. The ring arm 44 is pivoted to the ring rail 18 by bracket 45 which is adjacent to the shell shaft 34. The idler arms push the idler 38 out so that the distance from the drive pulley 26 to the idler pulley 38 and the distance from the idler pulley 38 to the shell 32 remains the same regardless of the distance from the drive pulley 26 to the shell 32. This idler arm movement could be accomplished by having a spring biasing either of the arms outward. However, we prefer to move the idler pulley outward by pivoting the two idler arms 42 and 44 between the ring rail 18 and the spindle rail 14. With the arms so positioned, it may be readily seen that the total distance from the drive shaft to the idler shaft and from the idler shaft to the shell is always the same. Also it may be seen for smooth operation, it is necessary for the arms to extend outward slightly when the ring rail 18 is in the full top position. Therefore, it is necessary that the length of the spindle idler arm 42 plus the length of the ring idler arm 44 be greater than the distance from the drive shaft 24 to the ring rail 18.

Figure 2:
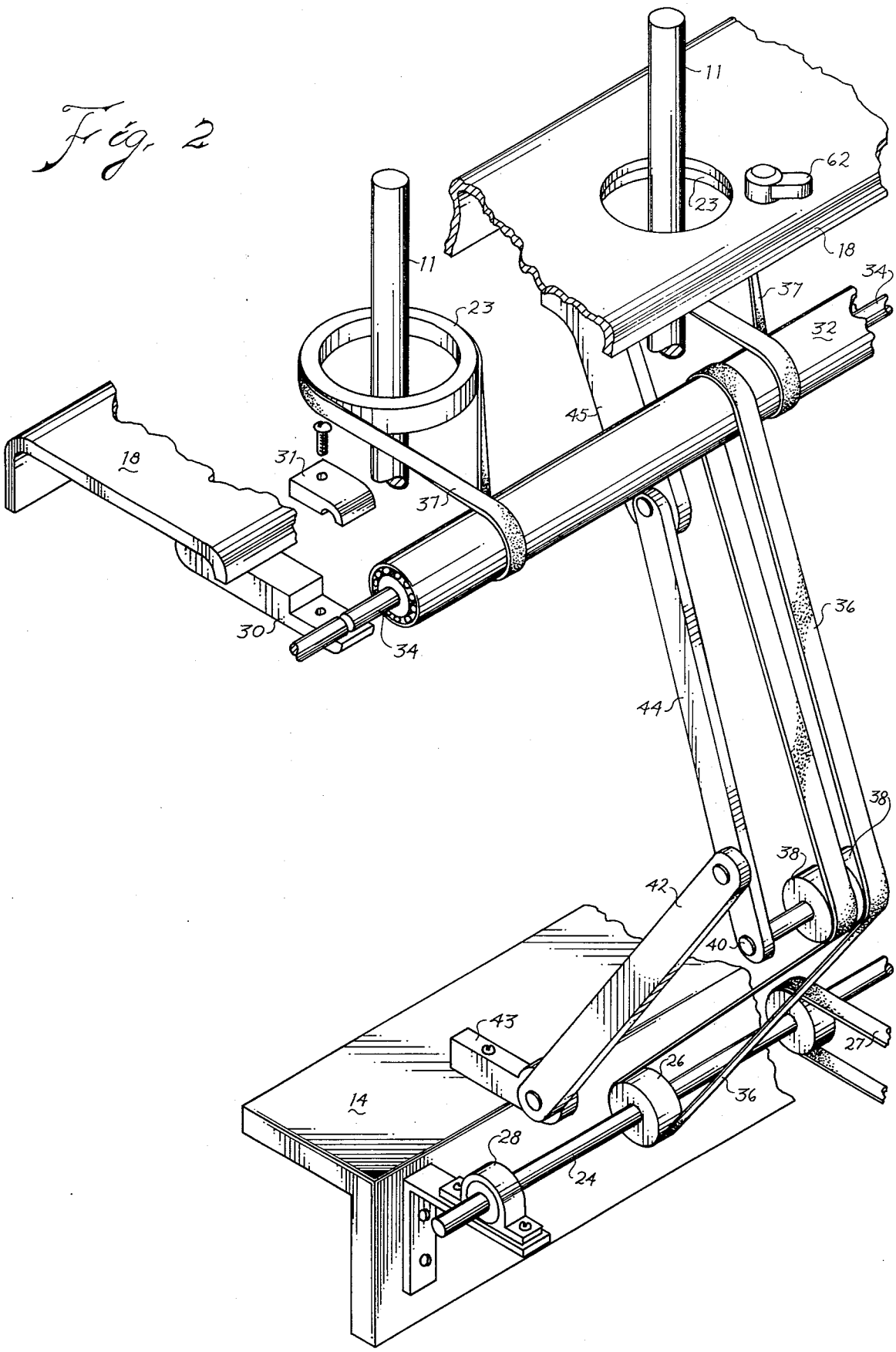
FIG. 2 is a schematic perspective representation thereof.

The drive belt 36 is trained over the pulleys as seen particularly in FIG. 2. It will also be understood from FIG. 2 there would be one belt 36 for four or more rings 20. A ring drive belt 37 would be used for each of the rings 20.

It should be understood that the idler arms 42 and 44 form a portion of compensating means on the frame for moving the idler pulleys responsive to movement of the ring rail so that the belt is always tight. We move the idler pulleys responsive to the movement of the ring rail so that the total distance from the drive pulley to the idler and from the idler pulley to the rail is always the same and belt is always taut.

Figure 3:
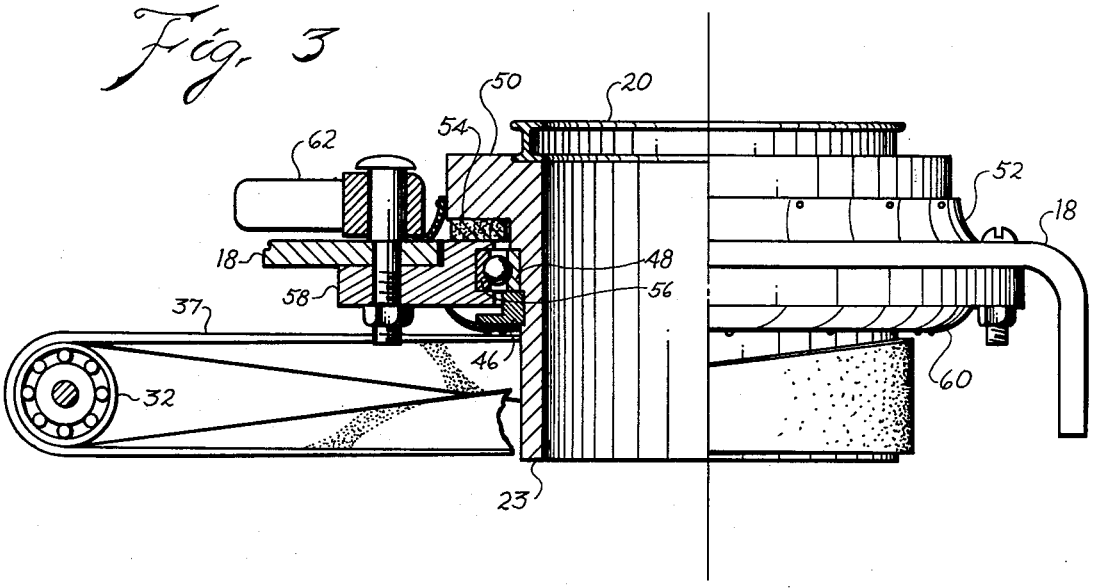
FIG. 3 is a half-sectional view of a ring with the drive belt trained therearound.

FIG. 3 shows in some detail as to the way the ring 20 is journaled to the rail 18. Also it will be noted that FIG. 3 does not show the traveler 22 upon the ring 20, however, those skilled in the art will understand this connection. Referring to FIG. 3, it may be seen that the holder 23 has a notch at about the middle of its external surfaces to receive lock ring 46. The inside race 48 of a bearing fits between the ring 46 and shoulder immediately above the race. The top of the sleeve shaped holder 23 has an outwardly extending flange 50. Dust seal 52 is attached to the outer edge of this flange 50 while pad 54 extends between the bottom of the flange 50 and retaining ring 58. The retaining ring 58 holds the outer race 56 firmly in place. Dust shield 60 is attached to the bottom lock ring 46. Thus we have journalled the ring 20 for high speed rotation.

A thumb and forefinger eccentric cam brake 62 is attached to the ring rail 18 and close to the flange 50 to stop the ring to piece up broken ends. The cam brake 62 is also seen in FIG. 2, but is omitted from FIG. 1 for clarity.

Thus it may be seen that we have provided an improved compensating drive for a ring of a spinning machine.

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 bobbin
11 spindle
12 yarn
14 spindle rail
16 bobbin belt
18 ring rail
20 ring
22 traveler
23 holder
24 drive shaft
26 drive pulley
27 belt, main
28 pillow block
29 main cylinder
30 arms
31 cap
32 shell
34 shell shaft
36 shell drive belt
37 ring drive belt
38 idler pulley
40 idler shaft
42 spindle idler arm
43 bracket
44 ring idler arm
45 bracket
46 lock ring
48 race, inner
50 flange
52 dust shield
54 pad
56 race, outer
58 retaining ring
60 dust shield
62 cam brake

We claim as our invention:

1. The improved method of rotating rings in a machine having a frame including a. a spindle rail,
b. bobbins on the spindle rail,
c. bobbins drive means on the frame for rotating the bobbins at high speed,
d. a ring rail around each bobbin mounted on the frame to move up and down,
e. a ring on the ring rail around each bobbin,
f. said ring mounted for rotation on the ring rail, and
g. a traveler on each ring for feeding yarn to each bobbin;

comprising the steps of:

h. extending a belt from a drive shaft and pulley on the spindle rail around two idler pulleys mounted on an idler shaft to a shell on the ring rail and a belt from the shell to the ring,
j. moving the idler pulleys responsive to the movement of the ring rail so that the total distance from the drive shaft to the idler shaft and from the idler shaft to the shell is always the same and the belts are always taut.

2. In a machine having a frame including a. a spindle rail,
b. bobbins on the spindle rail,
c. bobbin drive means on the frame for rotating the bobbins at high speed,
d. a ring rail around each bobbin mounted on the frame to move up and down,
e. a ring on the ring rail around each bobbin,
f. the ring mounted for rotation on the ring rail, and
g. a traveler on each ring for feeding yarn to each bobbin;

the improved structure for rotating each ring comprising;

h. a drive pulley on the spindle rail,
j. at least two idler pulleys for each drive pulley,
k. a shell journalled to the ring rail,
m. a belt trained around the drive pulley, idler pulleys and shell,
n. a ring drive belt from the shell to the rings, and
o. compensating means on the frame for moving the idler pulleys responsive to movement of the ring rail so that the total distance from the drive pulley to the idler pulleys and from the idler pulleys to the shell is always the same and the belt is always taut, and
p. said idler pulleys being mounted on the compensating means.

3. The invention as defined in claim 2 wherein said compensating means includes q. a ring idler arm pivoted to the ring rail, and r. said idler pulleys journaled to said arm.

4. The invention as defined in claim 3 further comprising:

s. a spindle idler arm (i) pivoted to the spindle rail, (ii) pivoted to the ring idler arm near the idler pulleys.

5. The invention as defined in claim 4 further comprising:

t. the length of the ring idler arm plus the length of the spindle idler arm being greater than the distance from the drive pulley to the ring rail.

6. The invention as defined in claim 5 further comprising:

u. a main cylinder on the frame, v. a belt from the main cylinder to said drive pulley.

7. The invention as defined in claim 2 further comprising:

q. a thumb and forefinger cam brake on the ring rail adjacent the ring to stop it for piecing up.

* * * * *